US011696064B2

(12) United States Patent
Zhou

(10) Patent No.: US 11,696,064 B2
(45) Date of Patent: Jul. 4, 2023

(54) WHISTLING SOUND SUPPRESSION METHOD, EARPHONE, AND STORAGE MEDIUM

(71) Applicants: Beijing Xiaomi Mobile Software Co., Ltd., Beijing (CN); Beijing Xiaomi Pinecone Electronics Co., Ltd., Beijing (CN)

(72) Inventor: Lingsong Zhou, Beijing (CN)

(73) Assignees: Beijing Xiaomi Mobile Software Co., Ltd., Beijing (CN); Beijing Xiaomi Pinecone Electronics Co., Ltd., Beijing (CN)

( * ) Notice: Subject to any disclaimer, the term of this patent is extended or adjusted under 35 U.S.C. 154(b) by 0 days.

(21) Appl. No.: 17/453,130

(22) Filed: Nov. 1, 2021

(65) Prior Publication Data

US 2023/0043525 A1 Feb. 9, 2023

(30) Foreign Application Priority Data

Jul. 29, 2021 (CN) ..... 202110876456.4

(51) Int. Cl.
*G10K 11/16* (2006.01)
*H04R 1/10* (2006.01)

(52) U.S. Cl.
CPC ..... *H04R 1/1083* (2013.01); *G10K 11/16* (2013.01); *H04R 1/1016* (2013.01)

(58) Field of Classification Search
CPC ..... H04R 1/1083; H04R 1/1016; G10K 11/16
USPC ..... 381/74
See application file for complete search history.

(56) References Cited

U.S. PATENT DOCUMENTS

| | | | | |
|---|---|---|---|---|
| 11,303,258 | B1 * | 4/2022 | Bajic | G10K 11/17854 |
| 2010/0092016 | A1 | 4/2010 | Iwano et al. | |
| 2012/0243716 | A1 * | 9/2012 | Puder | H04R 25/453 381/318 |
| 2014/0126733 | A1 * | 5/2014 | Gauger, Jr. | G10K 11/17835 381/71.6 |
| 2015/0172815 | A1 | 6/2015 | Park et al. | |
| 2016/0105751 | A1 * | 4/2016 | Zurbruegg | H04R 25/505 381/317 |

* cited by examiner

FOREIGN PATENT DOCUMENTS

| | | | |
|---|---|---|---|
| EP | 2999234 | A1 | 3/2016 |
| EP | 3240303 | A1 | 11/2017 |

OTHER PUBLICATIONS

Ramos, G. et al., "Direct Method With Random Optimization for Loudspeaker Equalization Using IIR Parametric Filters," Proceedings of the 2004 IEEE International Conference on Acoustics, Speech, and Signal Processing, May 17, 2004, Montreal, QC, Canada, 6 pages.

*Primary Examiner* — Carolyn R Edwards
*Assistant Examiner* — Friedrich Fahnert
(74) *Attorney, Agent, or Firm* — McCoy Russell LLP

(57) ABSTRACT

A whistling sound suppression method includes: obtaining an ambient audio signal, the ambient audio signal being a sound signal in a surrounding environment of an earphone; filtering the ambient audio signal according to a preset first filter group to obtain a first audio signal; obtaining an ear canal audio signal, the ear canal audio signal being a sound signal when the first audio signal propagates in an ear canal; and filtering a subsequently obtained ambient audio signal according to a preset second filter group to obtain a second audio signal in response to the ear canal audio signal meets a whistling condition.

18 Claims, 7 Drawing Sheets

WHISTLING SOUND SUPPRESSION METHOD, EARPHONE, AND STORAGE MEDIUM

CROSS-REFERENCE TO RELATED APPLICATION

The present application claims priority to Chinese Patent Application No. 202110876456.4 filed on Jul. 29, 2021. The entire contents of the above-listed application is hereby incorporated by reference for all purposes.

BACKGROUND

A noise-canceling earphone in related art has a transparent mode. If a user turns on the transparent mode of the earphone, a microphone of the earphone collects an ambient sound outside the earphone and processes the collected ambient sound, so that an ambient sound heard when the user is wearing the earphone is very close to the ambient sound heard when the user is not wearing the earphone.

However, in the case that the user is wearing the earphone and the transparent mode is turned on, if the earphone is touched by accidental pressing or other operations, a cavity structure of the earphone is changed, which will cause an acoustic transmission path to change, and cause a harsh whistling sound.

SUMMARY

The present disclosure relates to the technical field of signal processing, such as to a whistling sound suppression method, an earphone and a storage medium.

According to a first aspect of the present disclosure, a whistling sound suppression method is provided, and includes:

obtaining an ambient audio signal, the ambient audio signal being a sound signal in a surrounding environment of an earphone;

filtering the ambient audio signal according to a preset first filter group to obtain a first audio signal;

obtaining an ear canal audio signal, the ear canal audio signal being a sound signal when the first audio signal propagates in an ear canal; and filtering a subsequently obtained ambient audio signal according to a preset second filter group to obtain a second audio signal in response to the ear canal audio signal meets a whistling condition, wherein a gain value of the second filter group is smaller than a gain value of the first filter group.

According to a second aspect of the present disclosure, an earphone is provided, and includes:

a microphone, a loudspeaker, a processor, and a memory. The memory stores a computer program capable of running on the processor. When running the computer program, the processor is configured to execute a whistling sound suppression method, including:

obtaining an ambient audio signal, the ambient audio signal being a sound signal in a surrounding environment of an earphone;

filtering the ambient audio signal according to a preset first filter group to obtain a first audio signal;

obtaining an ear canal audio signal, the ear canal audio signal being a sound signal when the first audio signal propagates in an ear canal; and filtering a subsequently obtained ambient audio signal according to a preset second filter group to obtain a second audio signal in response to the ear canal audio signal meets a whistling condition, wherein a gain value of the second filter group is smaller than a gain value of the first filter group.

According to a third aspect of the present disclosure, a non-transitory computer-readable storage medium is provided. When a computer program is executed by a processor, a whistling sound suppression method is realized, including:

obtaining an ambient audio signal, the ambient audio signal being a sound signal in a surrounding environment of an earphone;

filtering the ambient audio signal according to a preset first filter group to obtain a first audio signal;

obtaining an ear canal audio signal, the ear canal audio signal being a sound signal when the first audio signal propagates in an ear canal; and filtering a subsequently obtained ambient audio signal according to a preset second filter group to obtain a second audio signal in response to the ear canal audio signal meets a whistling condition, wherein a gain value of the second filter group is smaller than a gain value of the first filter group.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate examples consistent with the disclosure and, together with the description, serve to explain principles of the disclosure.

DETAILED DESCRIPTION

Reference will now be made in detail to some embodiments, examples of which are illustrated in the accompanying drawings. When the following description refers to the accompanying drawings, like numbers in different drawings indicate the same or similar elements, unless otherwise indicated. The implementations described in the following embodiments are not representative of all implementations consistent with the disclosure. Rather, they are merely examples of apparatus consistent with certain aspects of the disclosure.

Figure 1:
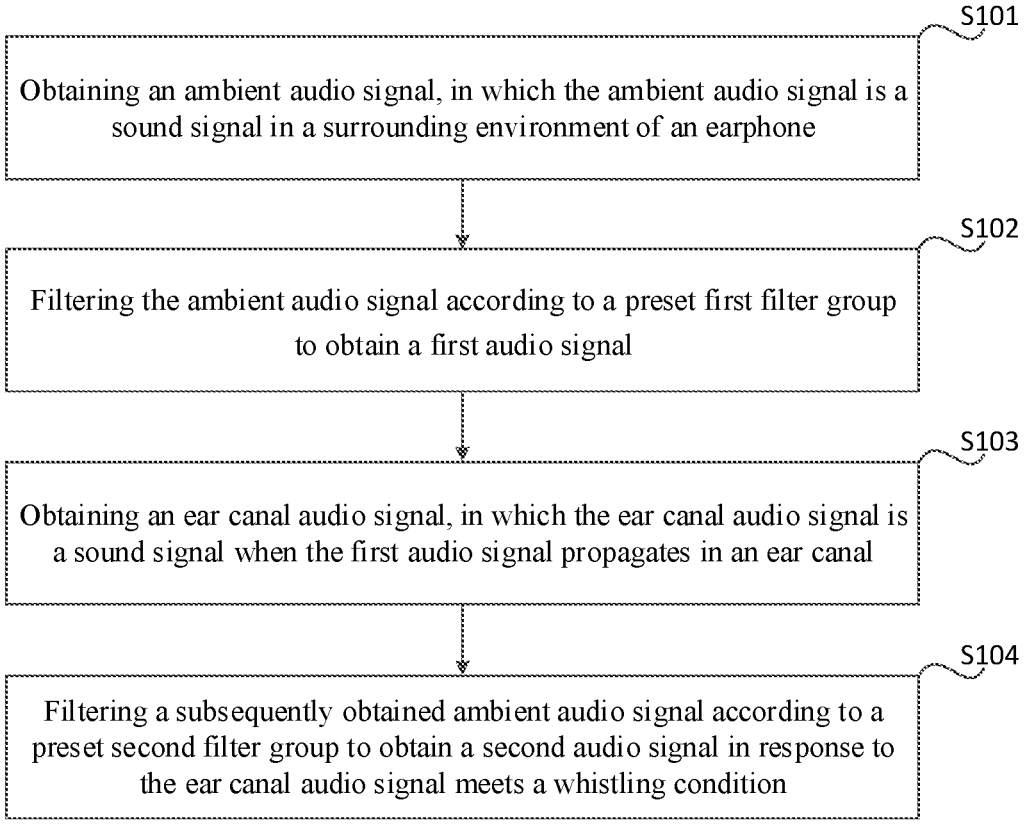
FIG. 1 is a schematic flow chart of a whistling sound suppression method according to one or more examples of the present disclosure.

An embodiment of the present disclosure provides a whistling sound suppression method. FIG. 1 is a schematic flow chart of a whistling sound suppression method according to an example of the present disclosure. As shown in FIG. 1, the method includes:

Step S101, an ambient audio signal is obtained. The ambient audio signal is a sound signal in a surrounding environment of an earphone.

Step S102, the ambient audio signal is filtered according to a preset first filter group to obtain a first audio signal.

Step S103, an ear canal audio signal is obtained. The ear canal audio signal is a sound signal when the first audio signal propagates in the ear canal.

Step S104, in response to the ear canal audio signal meets a whistling condition, a subsequently obtained ambient audio signal is filtered according to a preset second filter group to obtain a second audio signal.

In the embodiment of the disclosure, the whistling sound suppression method may be applied to the earphone with a transparent mode.

In step S101, if the earphone is in the transparent mode, the ambient audio signal in the surrounding environment of the earphone may be obtained through a first audio collection component of the earphone. The first audio collection component may be a first microphone disposed on the outer side of the earphone.

It should be noted that the transparent mode is configured to allow the sound signal in the surrounding environment of the earphone to enter the human ear. In order to allow a user to clearly hear the sound signal in the surrounding environment of the earphone, the ambient audio signal may be collected through the first microphone.

In step S102, gain filtering is performed on the ambient audio signal by using the first filter group, so that a signal intensity difference between the first audio signal output by the first filter group and the ambient audio signal is smaller than a preset value.

It can be understood that after the user wears the earphone, due to the physical isolation of the earphone itself, there may be a signal intensity difference between a sound signal in the external environment of the earphone and the sound signal heard by the user. Therefore, the obtained ambient audio signal is amplified through the first filter group, and a signal intensity difference between the amplified first audio signal and the audio signal of the external environment is smaller than the preset value, so that the user can clearly hear sounds of the external environment when wearing the earphone.

In step S103, the first audio signal may be output through an audio output component of the earphone, and the ear canal audio signal may be collected through a second audio collection component of the earphone to determine whether the ear canal audio signal meets the whistling condition or not.

Here, the audio output component may be a loudspeaker of the earphone, and the second audio collection component may be a second microphone disposed on the inner side of the earphone.

It should be noted that a cavity structure of the earphone changes due to the user pressing the earphone or other operations, then a propagation path of the ear canal audio signal changes, and the ear canal audio signal propagates to the first audio collection component of the earphone and is picked up by the first audio collection component to form a closed positive feedback loop. After the ear canal audio signal is amplified repeatedly, the signal intensity of certain frequency points exceeds an upper gain limit, and then self-oscillation may occur, resulting in a whistling sound, which not only is prone to damaging the earphone, but also may cause damage to the user's hearing and reduce the user experience.

Based on this, in the embodiment of the disclosure, whether the earphone may produce a whistling sound is predicted by collecting the ear canal audio signal and determining whether the ear canal audio signal meets the whistling condition.

In step S104, in response to the ear canal audio signal meets the whistling condition, that is, the earphone is about to produce the whistling sound, the subsequently collected ambient audio signal is filtered by the preset second filter group to obtain the second audio signal.

Since a gain value of the second filter group is smaller than a gain value of the first filter group, after the propagation path of the ear canal audio signal changes, by using the second filter group with a low gain intensity for filtering, the gain intensity of the ear canal audio signal in the positive feedback loop may be appropriately reduced. Thus, the signal intensity of certain frequency points in the ear canal audio signal may not exceed the upper gain limit, thus suppressing the whistling sound.

In the embodiment of the disclosure, the first filter group may include: at least one first filter, and the second filter group may include: at least one second filter.

In some embodiments, the first filter group includes: a first filter, and the second filter group includes: a second filter. A gain value of the second filter is smaller than a gain value of the first filter.

The ambient audio signal is obtained and then filtered by the first filter to obtain the first audio signal. The ear canal audio signal is obtained, and whether the ear canal audio signal meets the whistling condition is determined. If the ear canal audio signal meets the whistling condition, the subsequently obtained ambient audio signal is filtered by the second filter to obtain the second audio signal.

Optionally, the ear canal audio signal meeting the whistling condition includes:

a local peak-valley difference in a preset local frequency band range where a full-band peak point of the ear canal audio signal is located meets a first condition, and an amplitude change of the ear canal audio signal meets a second condition.

In the embodiment of the disclosure, the full-band peak point is: a frequency point with the largest amplitude in a full-band range; and the local peak-valley difference is: an amplitude difference between the frequency point with the largest amplitude and a frequency point with the smallest amplitude in the ear canal audio signal in the preset local frequency band range.

Here, the full-band range may be 0-24 kHz; and the preset local frequency band range may be set according to actual conditions. In some embodiments, the preset local frequency band range may be: ±1000 Hz.

By obtaining the frequency domain feature and time domain feature of the ear canal audio signal, whether the local peak-valley difference in the preset local frequency band range where the full-band peak point of the ear canal audio signal is located meets the first condition may be determined according to the frequency domain feature of the ear canal audio signal. In the case that the local peak-valley difference in the preset local frequency band range where the full-band peak point of the ear canal audio signal is located meets the first condition, whether the amplitude change of the ear canal audio signal meets the second condition is further determined according to the time domain feature of the ear canal audio signal. If the ear canal audio signal meets the second condition, it is determined that the ear canal audio signal meets the whistling condition, and the earphone is about to produce the whistling sound.

It can be understood that in order to improve the recognition accuracy of a whistling signal, the frequency domain feature and time domain feature of the ear canal audio signal may be obtained, if the frequency domain feature of the ear canal audio signal represents that the local peak-valley difference in the preset local frequency band range where the full-band peak point of the ear canal audio signal is located meets the first condition and the time domain feature of the ear canal audio signal represents that the amplitude change of the ear canal audio signal meets the second condition, it can be determined that the earphone is about to produce the whistling sound, and thus gain filtering is performed through the preset second filter group to suppress the whistling sound.

Optionally, the first condition includes:

the local peak-valley difference is greater than a first threshold.

In the embodiment of the disclosure, by comparing the local peak-valley difference with the first threshold, if the local peak-valley difference is greater than the first threshold, it is determined that the local peak-valley difference in the preset local frequency band range where the full-band peak point of the ear canal audio signal is located meets the first condition.

Here, the value range of the first threshold may be: 25 dB-35 dB. In some embodiments, the first threshold may be 30 dB.

It should be noted that there is a single and fixed whistling frequency point in a spectrogram of the whistling signal, and an amplitude corresponding to the whistling frequency point is much greater than amplitudes of other frequency points in the audio signal. Therefore, whether the local peak-valley difference in the preset local frequency band range where the full-band peak point of the ear canal audio signal is located is greater than the first threshold is determined, and if yes, it may be determined that the local peak-valley difference in the preset local frequency band range where the full-band peak point of the ear canal audio signal is located meets the first condition.

Optionally, the second condition includes:

an amplitude change trend of the ear canal audio signal is that an amplitude gradually increases.

In the embodiment of the disclosure, the amplitude change trend of the ear canal audio signal may be determined according to the time domain feature of the ear canal audio signal, and if the amplitude change trend of the ear canal audio signal is that the amplitude gradually increases (namely, showing an increasing trend), it is determined that the amplitude change of the ear canal audio signal meets the second condition.

In practical applications, whether the amplitude change trend of the ear canal audio signal is that the amplitude gradually increases may be determined in the following way: amplitude energy of each frame of data is calculated, and amplitude energy data of the frames of data is counted; linear regression calculation is performed according to the amplitude energy data of the frames of data, and whether the slope is greater than 0 is determined according to a linear regression result; if the slope is greater than 0, it means that the amplitude change trend of the ear canal audio signal is that the amplitude gradually increases; on the contrary, it means that the amplitude change trend of the ear canal audio signal is that the amplitude gradually decreases.

In some embodiments, the second condition includes:

the amplitude change trend of the ear canal audio signal within a preset time range is that the amplitude gradually increases.

Here, the preset time range may be set according to actual needs.

It should be noted that a time-domain waveform of the whistling signal is a sine wave with a relatively constant frequency. The amplitude of the whistling signal may increase rapidly with the increase of time until exceeding an amplification region of a power amplifier, and when entering a saturation region and a cut-off region, a clipping phenomenon is generated. Therefore, the amplitude of the whistling signal shows an increasing trend within a certain time range.

Optionally, the first filter group is configured for transparent filtering, and the second filter group is configured for transparent filtering and whistling sound suppression.

In the embodiment of the disclosure, due to the physical isolation of the earphone itself, there is a signal intensity difference between the sound signal in the external environment of the earphone and the sound signal heard by the user. In order to make the intensity of the sound signal heard by the user after wearing the earphone the same with or similar to the intensity of the sound signal in the external environment of the earphone, the obtained ambient audio signal may be amplified by the first filter group so as to compensate for the signal intensity difference caused by the earphone itself, and realize the transparent filtering of the ambient audio signal.

However, in actual use, if the earphone is in the transparent mode, the cavity structure of the earphone changes due to the user pressing the earphone or other operations, the propagation path of the ear canal audio signal changes, and the ear canal audio signal propagates to the first audio collection component of the earphone and is picked up by the first audio collection component to form a closed positive feedback loop. After the ear canal audio signal is amplified repeatedly, the signal intensity of certain frequency points exceeds the upper gain limit, and then self-oscillation may occur, resulting in the whistling sound.

Thus, in order to suppress the whistling sound of the earphone, filtering may be performed by the second filter group with the gain value smaller than the gain value of the first filter group. On one hand, by using the second filter group, the gain intensity of the ear canal audio signal in the positive feedback loop is appropriately reduced, so that the signal intensity of certain frequency points may not exceed the upper gain limit after the ear canal audio signal is amplified repeatedly, thus suppressing the whistling sound. On the other hand, by amplifying the subsequently obtained ambient audio signal through the second filter group, the signal intensity difference caused by the earphone itself may also be appropriately compensated so as to achieve the transparent filtering of the ambient audio signal.

Optionally, the first filter group includes: a plurality of first filters; and the second filter group includes: a plurality of second filters.

The first filters and the second filters are of the same number and are in one-to-one correspondence.

A gain value of each second filter is smaller than a gain value of the first filter corresponding to the second filter.

In the embodiment of the disclosure, the number of the first filters and the number of the second filters may be set according to actual needs. For example, the number of the first filters and the number of the second filters may be 6.

In some embodiments, the gain value of each second filter is ⅔ of the gain value of the first filter corresponding to the second filter.

In the embodiment of the disclosure, ⅔ may be the value after many tests of the disclosure; however, the protection scope of the disclosure is not limited to this, for example, the gain value of each second filter is 0.6 time of the gain value of the first filter corresponding to the second filter; or, the gain value of each second filter is 0.7 time of the gain value of the first filter corresponding to the second filter.

Optionally, a frequency value of each second filter is equal to a frequency value of the first filter corresponding to the second filter.

Q value of each second filter is equal to a Q value of the first filter corresponding to the second filter.

In the embodiment of the disclosure, the frequency value may be a center frequency value of each filter; and the Q value represents a quality factor of each filter.

Here, the Q value may be determined by the following formula:

$$Q=f/B,$$

where f is the center frequency value of each filter, and B is a bandwidth of each filter.

It can be understood that the larger the Q value of each filter, the narrower the bandwidth of the filter, while the smaller the Q value of each filter, the wider the bandwidth of the filter.

In some embodiments, by obtaining a passive noise canceling curve of the earphone, filtering parameters of each first filter in the first filter group and filtering parameters of each second filter in the second filter group may be determined based on the passive noise canceling curve.

Here, the filtering parameters include: the frequency values and the Q values.

It can be understood that the passive noise canceling curve of the earphone may be a signal intensity change curve of the ambient audio signal caused by the physical isolation of the earphone. After the passive noise canceling curve of the earphone is determined, the filtering parameters of each first filter in the first filter group are determined based on the passive noise canceling curve, so that a gain curve of the first filter group is fitted with the passive noise canceling curve so as to realize the transparent filtering function of the first filter group.

Since the second filter group is configured to perform transparent filtering on the ambient audio signal and perform whistling sound suppression on the ear canal audio signal, an amplitude of a gain curve of the second filter group is smaller than an amplitude of the gain curve of the first filter group, but a curve shape of the gain curve of the second filter group is the same as that of the gain curve of the first filter group. Therefore, the filtering parameters of each second filter may be determined according to the filtering parameter of each first filter, and the filtering parameters of each second filter are equal to those of the first filter corresponding to the second filter.

Optionally, the first condition includes:

the local peak-valley difference is greater than a second threshold. The second threshold is greater than the first threshold.

In the embodiment of the disclosure, the value range of the second threshold is 45 dB-55 dB. In some embodiments, the second threshold may be 50 dB.

Optionally, the method further includes:

the subsequently obtained ambient audio signal is filtered according to a preset third filter group to obtain a third audio signal in response to the local peak-valley difference is greater than the second threshold.

In the embodiment of the disclosure, by comparing the local peak-valley difference of the ear canal audio signal with the second threshold, in response to the local peak-valley difference is greater than the second threshold, it means that the intensity of the whistling signal in the ear canal audio signal is relatively high, and the subsequently obtained ambient audio signal may be filtered by the preset third filter group.

In consideration of whistling sounds with different signal intensities, in the embodiment of the disclosure, in response to the ear canal audio signal meets the whistling condition, and the intensity of the whistling signal in the ear canal audio signal is relatively high, filtering is performed by the third filter group to enhance the suppression of the whistling sound, thus improving the effectiveness of whistling sound suppression.

In some embodiments, in response to the ear canal audio signal meets the whistling condition, and the local peak-valley difference of the ear canal audio signal is greater than the first threshold and smaller than the second threshold, the subsequently obtained ambient audio signal is filtered according to the preset second filter group to obtain the second audio signal.

In response to the ear canal audio signal meets the whistling condition, and the local peak-valley difference of the ear canal audio signal is greater than the second threshold, the subsequently obtained ambient audio signal is filtered according to the preset third filter group to obtain the third audio signal.

In the embodiment of the disclosure, the first threshold may be 30 dB, and the second threshold may be 50 dB.

In consideration of the whistling sounds with different signal intensities, in order to improve the suppression effect on the whistling sounds, on the basis that the ear canal audio signal meets the whistling condition, the signal intensity of the whistling signal in the ear canal audio signal may be determined according to the local peak-valley difference of the ear canal audio signal so as to employ a filter group corresponding to the signal intensity of the whistling signal to perform filtering.

Optionally, the gain value of the second filter group is smaller than the gain value of the first filter group; and a gain value of the third filter group is smaller than a gain value of the second filter group.

In the embodiment of the disclosure, the third filter group may include: a plurality of third filters; and the second filter group may include: the plurality of second filters.

The second filters and the third filters are of the same number and are in one-to-one correspondence.

The gain value of each third filter is smaller than the gain value of the second filter corresponding to the third filter.

A frequency value of each third filter is equal to the frequency value of the second filter corresponding to the third filter.

A Q value of each third filter is equal to the Q value of the second filter corresponding to the third filter.

In the embodiment of the disclosure, since the third filters are configured to perform transparent filtering on the ambient audio signal and perform whistling sound suppression on the ear canal audio signal, and relative to the second filter group, the third filter group is configured to filter the ear canal audio signal with the local peak-valley difference greater than the second threshold (that is, an ear canal audio signal with a greater whistling signal intensity), an amplitude (i.e., the gain value) of the gain curve of the third filter group is smaller than an amplitude of the gain curve of the second filter group, but a curve shape of the gain curve of the third filter group is the same as that of the gain curve of the second filter group. Therefore, the filtering parameters of each third filter may be determined according to the filtering parameters of each second filter, and the filtering parameters of each third filter are equal to those of the second filter corresponding to the third filter.

Figure 2:
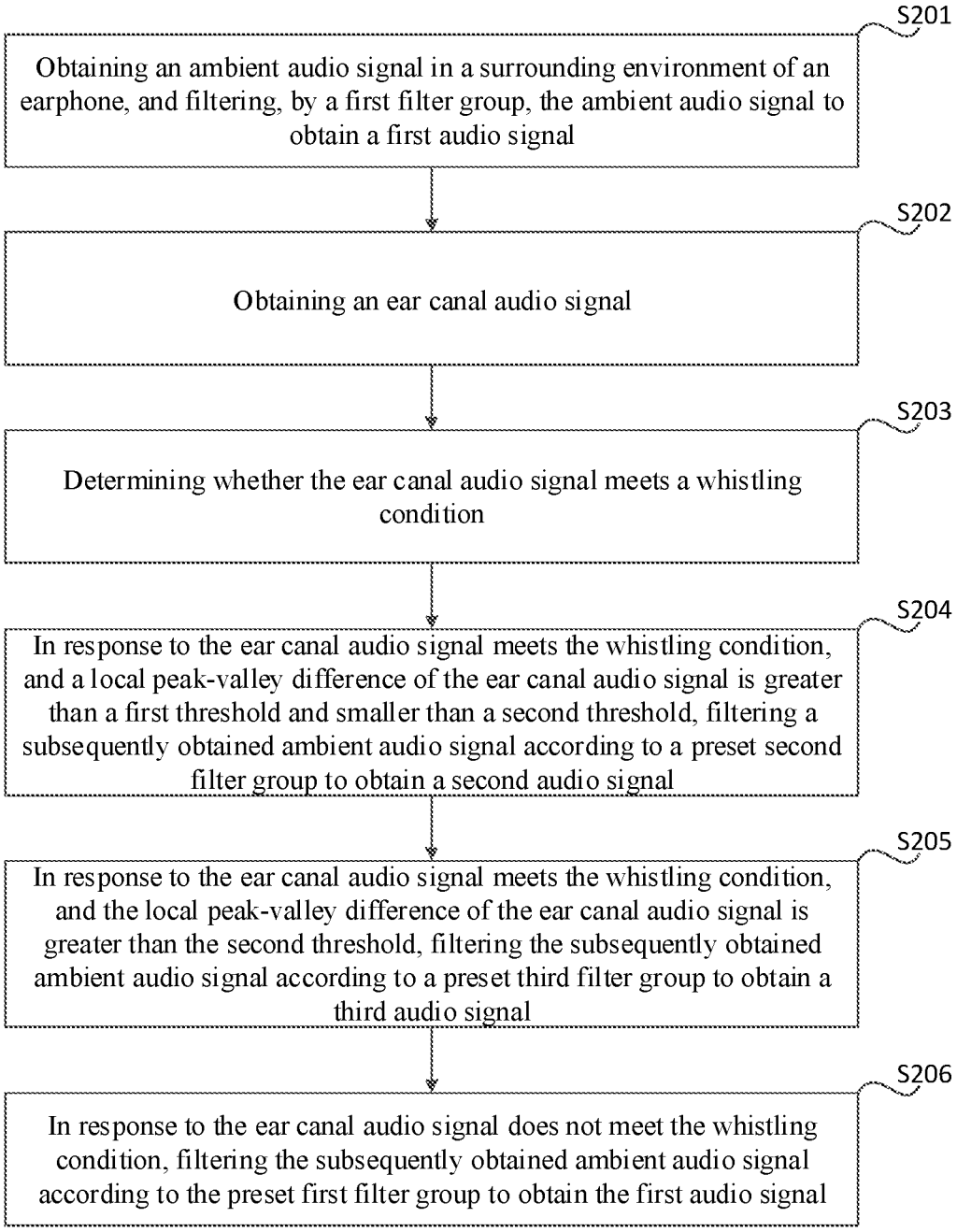
FIG. 2 is a schematic flow chart of a whistling sound suppression method according to one or more examples of the present disclosure.

The disclosure further provides the following embodiment:

FIG. 2 is a schematic flow chart of a whistling sound suppression method according to an example of the present disclosure. The method includes:

Step S201, an ambient audio signal in a surrounding environment of an earphone is obtained, and the ambient audio signal is filtered by a first filter group to obtain a first audio signal.

In this example, the ambient audio signal may be collected through a feed-forward microphone in the wireless earphone.

It should be noted that in the related art, the wireless earphone includes a noise canceling mode and a transparent mode, the noise canceling mode is configured to block an audio signal from the external environment, while the transparent mode is configured to allow the audio signal of the external environment to enter the human ear. If the wireless earphone is in the transparent mode, the first audio signal of the external environment is collected through the feed-forward microphone.

Due to certain physical isolation of the wireless earphone itself, after a user wears wireless earphones, there may be a signal intensity difference between the audio signal from the external environment and an audio signal heard by the user. Thus, the first audio signal collected by the feed-forward microphone is amplified by a transparent filter, and a signal intensity difference between the amplified first audio signal and the audio signal from the external environment is smaller than a preset value, so that the user can clearly hear sounds in the external environment when wearing the wireless earphones.

In some embodiments, a passive noise canceling curve of an audio device is obtained, and filtering parameters of the first filter group are determined based on the passive noise canceling curve.

Here, the filtering parameters may include: frequency values and Q values.

In this example, the passive noise canceling curve may be a signal intensity change curve of the audio signal caused by the physical isolation of the wireless earphone.

Figure 3:
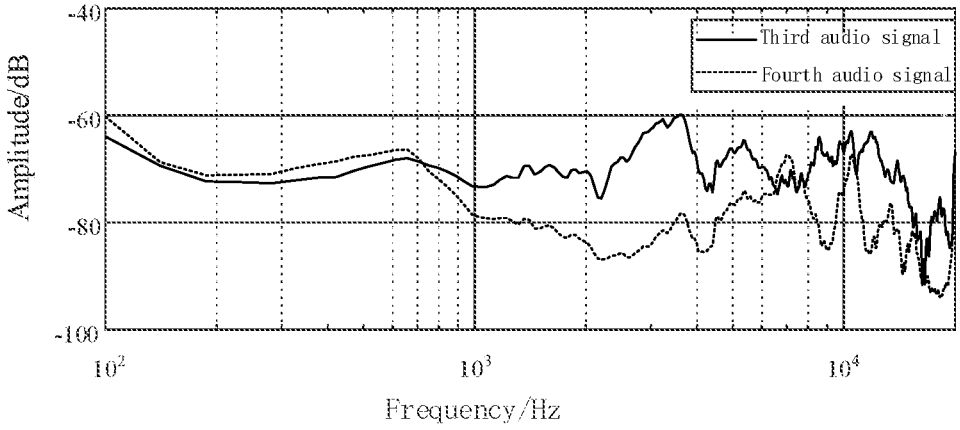
FIG. 3 is frequency response curves of a third audio signal and a fourth audio signal according to one or more examples of the present disclosure.
Figure 4:
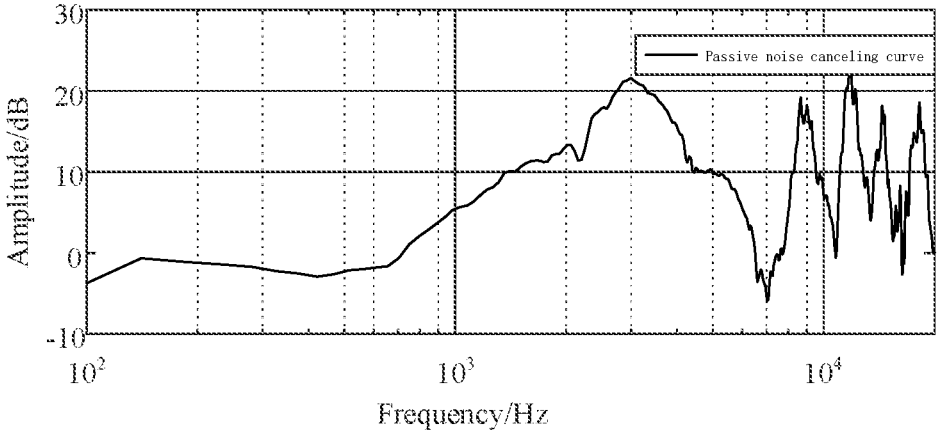
FIG. 4 is a schematic diagram of a passive noise canceling curve of a wireless earphone according to one or more examples of the present disclosure.

It can be understood that the wireless earphone needs to be measured on the acoustic characteristics before it leaves a factory. The coefficient design of the transparent filter of the wireless earphone is the key to the transparent mode. An artificial head model may be used to collect a third audio signal before wearing the earphone and a fourth audio signal for passive noise canceling after wearing the earphone. As shown in FIG. 3, FIG. 3 is frequency response curves of the third audio signal and the fourth audio signal according to an example of the present disclosure. A passive noise canceling curve of the wireless earphone, namely a target gain curve of the transparent filter, may be determined by comparing the frequency response curve of the third audio signal with the frequency response curve of the fourth audio signal. As shown in FIG. 4, FIG. 4 is a schematic diagram of the passive noise canceling curve of the wireless earphone according to an example of the present disclosure.

After the passive noise canceling curve is determined, coefficients of the first filter group are determined, so that a gain curve of the first filter group may be similar to the passive noise canceling curve.

In this example, the first filter group may be 6 cascaded second-order IIR filters.

Specifically, a first gain curve is determined based on initial values of the frequency, gain, and Q value in each IIR filter, and by updating the frequency, gain, and Q value, a second gain curve is determined based on the updated frequency, gain, and Q value. A first difference is obtained by comparing the first gain curve with the passive noise canceling curve. A second difference is obtained by comparing the second gain curve with the passive noise canceling curve. If the second difference is smaller than the first difference, the updated frequency, gain, and Q value are determined as the initial values of each IIR filter. The frequency, gain, and Q value continue to be updated until the second difference is equal to the first difference, and the current values of frequency, gain, and Q value are determined as the filtering parameters of each IIR filter.

Figure 5:
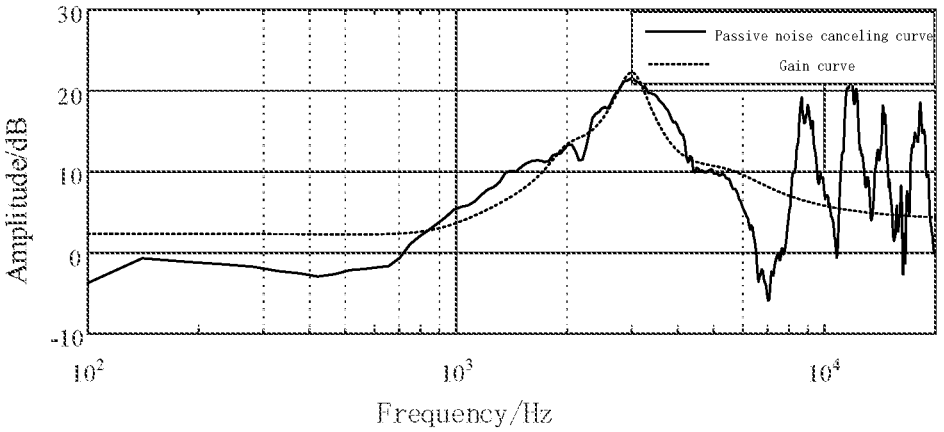
FIG. 5 is a schematic diagram of a gain curve of a first filter group and a passive noise canceling curve of a wireless earphone according to one or more examples of the present disclosure.

Exemplarily, as shown in FIG. 5, FIG. 5 is a schematic diagram of the gain curve of the first filter group and the passive noise canceling curve of the wireless earphone according to an example of the present disclosure. As shown in Table 1, Table 1 is a coefficient table of the first filter group.

TABLE 1

Filtering parameter table of the first filter group

| Type | Gain value | Frequency value | Q value |
|---|---|---|---|
| First IIR filter 1 | 12 | 3000 | 0.9 |
| First IIR filter 2 | 4 | 1400 | 1 |
| First IIR filter 3 | 4 | 3800 | 1 |
| First IIR filter 4 | 2 | 2000 | 1 |
| First IIR filter 5 | 5 | 8000 | 1 |
| First IIR filter 6 | 4 | 1000 | 1 |

In some embodiments, filtering parameters of a second filter group and filtering parameters of a third filter group are determined based on the filtering parameters of the first filter group.

In this example, after the filtering parameters of the first filter group are determined, the filtering parameters of the second filter group and the filtering parameters of the third filter group are determined based on the filtering parameters of the first filter group. Thus, a filtering gain of the second filter group is smaller than a filtering gain of the first filter group, and a filtering gain of the third filter group is smaller than a filtering gain of the second filter group.

It can be understood that second filters in the second filter group and first filters in the first filter group are of the same number, and are in one-to-one correspondence.

A filtering gain of each second filter is smaller than a filtering gain of the first filter corresponding to the second filter. Filtering parameters of each second filter are equal to those of the first filter corresponding to the second filter. Exemplarily, as shown in Table 2, Table 2 is a filtering parameter table of the second filter group.

TABLE 2

Filtering parameter table of the second filter group

| Type | Gain value | Frequency value | Q value |
|---|---|---|---|
| Second IIR filter 1 | 8 | 3000 | 0.9 |
| Second IIR filter 2 | 2 | 1400 | 1 |
| Second IIR filter 3 | 2 | 3800 | 1 |
| Second IIR filter 4 | 1 | 2000 | 1 |
| Second IIR filter 5 | 2.4 | 8000 | 1 |
| Second IIR filter 6 | 2 | 1000 | 1 |

Third filters in the third filter group and the second filters in the second filter group are of the same number, and are in one-to-one correspondence.

Figure 6:
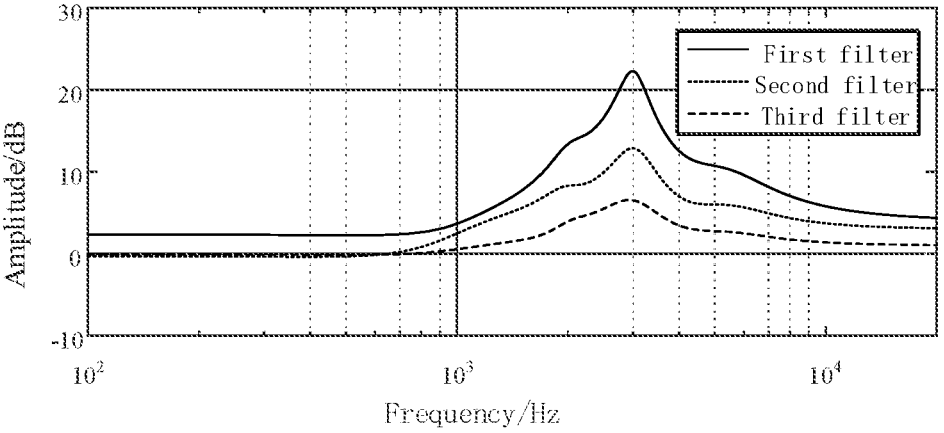
FIG. 6 is gain curves of a first filter group, a second filter group and a third filter group according to one or more examples of the present disclosure.

A filtering gain of each third filter is smaller than the filtering gain of the second filter corresponding to the third filter. Filtering parameters of each third filter are equal to those of the second filter corresponding to the third filter. Also exemplarily, as shown in Table 3, Table 3 is a filtering parameter table of the third filter group. As shown in FIG. 6, FIG. 6 is gain curves of the first filter group, the second filter group and the third filter group according to an example of the present disclosure.

TABLE 3

Filtering parameter table of the third filter group

| Type | Gain value | Frequency value | Q value |
|---|---|---|---|
| Third IIR filter 1 | 3.5 | 3000 | 0.9 |
| Third IIR filter 2 | 1 | 1400 | 1 |
| Third IIR filter 3 | 1 | 3800 | 1 |
| Third IIR filter 4 | 0.2 | 2000 | 1 |
| Third IIR filter 5 | 1.2 | 8000 | 1 |
| Third IIR filter 6 | 1 | 1000 | 1 |

After the filtering parameters of the first filter group, the second filter group, and the third filter group are determined, the filtering parameters may be burned to the wireless earphone before the wireless earphone leaves the factory. The filtering parameters of the filter groups in the wireless earphone may also be updated subsequently when the wireless earphone is upgraded.

Step S202, an ear canal audio signal is obtained.

In this example, the ear canal audio signal propagating in the ear canal may be collected through a feed-back microphone in the wireless earphone.

After the user wears the wireless earphone, the ambient audio signal of the external environment is collected by the feed-forward microphone, and the ambient audio signal is amplified by the first filter group to obtain the first audio signal; the first audio signal is played by a loudspeaker in the wireless earphone; and the ear canal audio signal propagating in the ear canal is collected by the feed-back microphone.

It should be noted that due to the portability of the wireless earphone, the distance between the feed-forward microphone and the loudspeaker in the wireless earphone is relatively short. When a cavity structure of the earphone changes due to the user pressing the earphone or other operations, a propagation path of the audio signal is changed, that is, the first audio signal played by the loudspeaker is transmitted to a position near the feed-forward microphone, and then is collected by the feed-forward microphone and transmitted to the loudspeaker, resulting in closed-loop forward feedback of the filter. After several positive feedback cycles, a signal of a certain frequency point in the audio signal is infinitely amplified to form a whistling sound, which reduces the user experience.

Therefore, in this example, the ear canal audio signal is collected by the feed-back microphone, so that whistling detection may be performed subsequently based on the ear canal audio signal.

Step S203, whether the ear canal audio signal meets the whistling condition is determined.

In this example, whether the ear canal audio signal meets the whistling condition may be determined by determining whether a local peak-valley difference in a preset local frequency band range where a full-band peak point of the ear canal audio signal is located meets a first condition, and whether an amplitude change of the ear canal audio signal meets a second condition.

Here, the first condition is that the local peak-valley difference of the ear canal audio signal is greater than a first threshold; and the second condition is that an amplitude change trend of the ear canal audio signal is that an amplitude gradually increases.

The local peak-valley difference is an amplitude difference between a spectral peak of the ear canal audio signal and a spectral valley of the ear canal audio signal in the preset local frequency band range.

Here, the preset local frequency band range and the first threshold may be set according to actual needs. For example, the preset local frequency band range may be: ±1000 Hz; and the first threshold may be 30 dB.

Frequency domain and time domain analysis is performed on the ear canal audio signal collected by the feed-back microphone. Whether the local peak-valley difference of the ear canal audio signal in the preset local frequency band range is greater than the first threshold is determined, and if the local peak-valley difference of the ear canal audio signal in the preset local frequency band range is greater than the first threshold, it may be determined that the ear canal audio signal meets the first condition. Furthermore, whether the amplitude change trend of the ear canal audio signal is an increasing trend is determined. If the amplitude change trend of the ear canal audio signal is the increasing trend, it is determined that the ear canal audio signal meets the first condition and the second condition at the same time, that is, the ear canal audio signal meets the whistling condition, and the earphone is about to produce the whistling sound.

Figure 7:
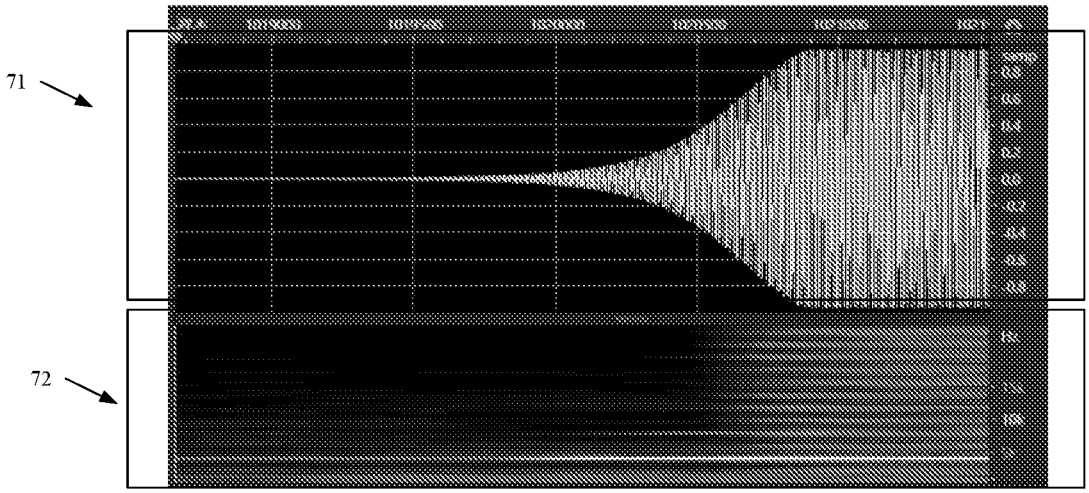
FIG. 7 is a schematic diagram of a time-domain waveform and a spectrum of a whistling signal according to one or more examples of the present disclosure.

It should be noted that, as shown in FIG. 7, FIG. 7 is a schematic diagram of a time-domain waveform and a spectrum of a whistling signal according to an example of the present disclosure. A reference sign 71 indicates the time-domain waveform of the whistling signal, and a reference sign 72 indicates a spectrogram of the whistling signal. The time-domain waveform of the whistling signal is a sine wave with a constant frequency. The amplitude of the whistling signal may increase rapidly with the increase of time until exceeding an amplification region of a power amplifier and enters a saturation region and a cut-off region so as to generate a clipping phenomenon. The spectrogram of the whistling signal has a single and fixed whistling frequency point, and an amplitude corresponding to the whistling frequency point is much greater than amplitudes of other frequency points in a second audio signal.

Step S204, in response to the ear canal audio signal meets the whistling condition, and the local peak-valley difference of the ear canal audio signal is greater than the first threshold and smaller than a second threshold, a subsequently obtained ambient audio signal is filtered according to the preset second filter group to obtain a second audio signal.

In this example, the first threshold and the second threshold may be set according to actual needs. For example, the first threshold is 30 dB, and the second threshold is 50 dB.

In this example, if the ear canal audio signal meets the whistling condition, it means that the earphone is about to produce a whistling sound. The signal intensity of the whistling signal in the ear canal audio signal may be determined according to the local peak-valley difference of the ear canal audio signal so as to determine a filter group to suppress the whistling sound according to the signal intensity of the whistling signal.

If the local peak-valley difference of the ear canal audio signal is greater than the first threshold and smaller than the second threshold, on one hand, transparent filtering may be performed on the subsequently obtained ambient audio signal by the preset second filter group, and on the other hand, whistling sound suppression may be performed on the ear canal audio signal by the preset second filter group.

Step S205, in response to the ear canal audio signal meets the whistling condition, and the local peak-valley difference of the ear canal audio signal is greater than the second threshold, the subsequently obtained ambient audio signal is filtered according to the preset third filter group to obtain a third audio signal.

In this example, if the ear canal audio signal meets the whistling condition, it means that the earphone is about to produce a whistling sound. According to the local peak-valley difference of the ear canal audio signal, if the local peak-valley difference of the ear canal audio signal is greater than the second threshold, it means that the signal intensity of the whistling signal in the ear canal audio signal is relatively large. In order to effectively suppress the whistling sound, on one hand, transparent filtering may be performed on the subsequently obtained ambient audio signal by the preset third filter group, and on the other hand, whistling sound suppression may be performed on the ear canal audio signal by the preset third filter group.

Step S206, in response to the ear canal audio signal does not meet the whistling condition, the subsequently obtained ambient audio signal is filtered according to the preset first filter group to obtain the first audio signal.

In this example, if the ear canal audio signal does not meet the whistling condition, it means that a current whistling risk has been cleared, and the first filter group may continue to be employed to filter the ambient audio signal.

Figure 8:
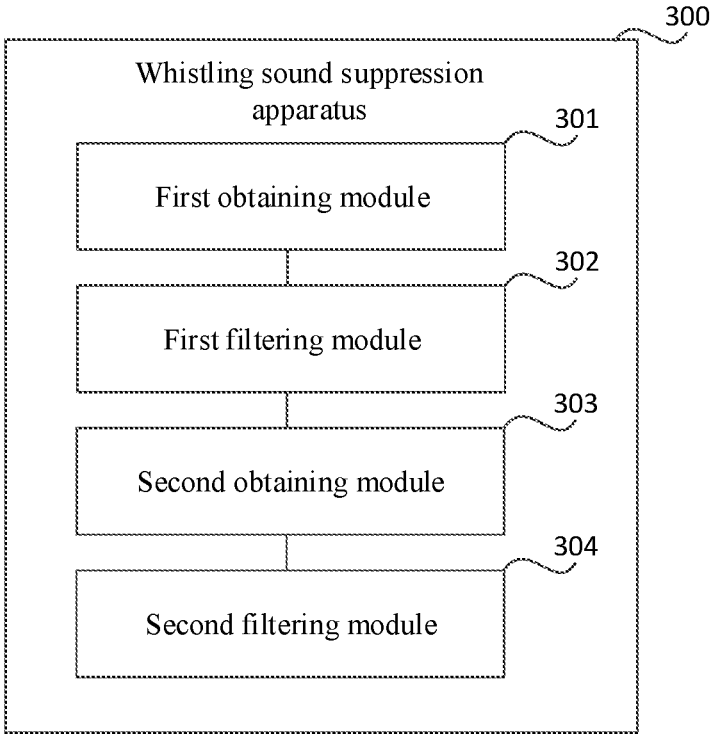
FIG. 8 is a schematic structural diagram of a whistling sound suppression apparatus according to one or more examples of the present disclosure.

An embodiment of the disclosure further provides a whistling sound suppression apparatus. FIG. 8 is a schematic structural diagram of the whistling sound suppression apparatus according to an example of the present disclosure. As shown in FIG. 8, the whistling sound suppression apparatus 300 includes:

a first obtaining module 301, configured to obtain an ambient audio signal, the ambient audio signal being a sound signal in a surrounding environment of an earphone;

a first filtering module 302, configured to filter the ambient audio signal according to a preset first filter group to obtain a first audio signal;

a second obtaining module 303, configured to obtain an ear canal audio signal, the ear canal audio signal being a sound signal when the first audio signal propagates in the ear canal; and a second filtering module 304, configured to filter a subsequently obtained ambient audio signal according to a preset second filter group to obtain a second audio signal in response to the ear canal audio signal meets a whistling condition, a gain value of the second filter group being smaller than a gain value of the first filter group.

Optionally, the ear canal audio signal meeting the whistling condition includes:

a local peak-valley difference in a preset local frequency band range where a full-band peak point of the ear canal audio signal is located meets a first condition, and an amplitude change of the ear canal audio signal meets a second condition.

Optionally, the first condition includes:

the local peak-valley difference is greater than a first threshold.

Optionally, the preset local frequency band range is: ±1000 Hz.

Optionally, the second condition includes:

an amplitude change trend of the ear canal audio signal is that an amplitude gradually increases.

Optionally, the first filter group is configured for transparent filtering, and the second filter group is configured for transparent filtering and whistling sound suppression Optionally, the first filter group includes: a plurality of first filters; and the second filter group includes: a plurality of second filters.

The first filters and the second filters are of the same number and are in one-to-one correspondence.

A gain value of each second filter is smaller than a gain value of the first filter corresponding to the second filter.

Optionally, a frequency value of each second filter is equal to a frequency value of the first filter corresponding to the second filter.

A Q value of each second filter is equal to that of the first filter corresponding to the second filter.

Optionally, the first condition includes:

the local peak-valley difference is greater than a second threshold. The second threshold is greater than the first threshold.

Optionally, the second filtering module is further configured to:

filter the subsequently obtained ambient audio signal according to a preset third filter group to obtain a third audio signal in response to the local peak-valley difference is greater than the second threshold.

Optionally, the gain value of the second filter group is smaller than the gain value of the first filter group; and a gain value of the third filter group is smaller than a gain value of the second filter group.

An embodiment of the disclosure further provides an earphone, including:

a microphone, a loudspeaker, a processor, and a memory. The memory stores a computer program capable of running on the processor. The processor is configured to execute the steps of the whistling sound suppression method according to one or more of the above technical solutions when running the computer program.

Here, the earphone provided by the embodiment of the disclosure is a single earphone. A user needs a pair of earphones in use, that is, two earphones as described in the embodiment of the disclosure. Each earphone includes a microphone, a loudspeaker, a processor, and a memory.

Figure 9:
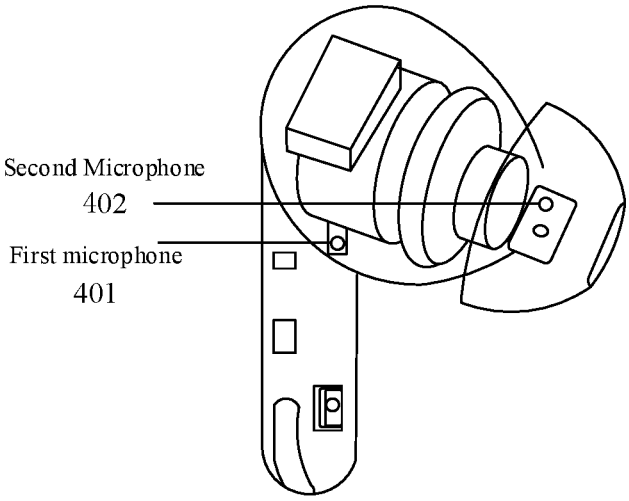
FIG. 9 is a schematic structural diagram of an earphone according to one or more examples of the present disclosure.

Optionally, as shown in FIG. 9 which is a schematic structural diagram of the earphone according to an example of the present disclosure, the microphone includes: a first microphone 401 and a second microphone 402.

The first microphone 401 is disposed at a position, outside the ear canal, in the earphone when the earphone is worn.

The second microphone 402 is disposed at a position, in the ear canal, in the earphone when the earphone is worn.

In the present disclosure, the first microphone is configured to collect an ambient audio signal; and the second microphone is configured to collect an ear canal audio signal.

Figure 10:
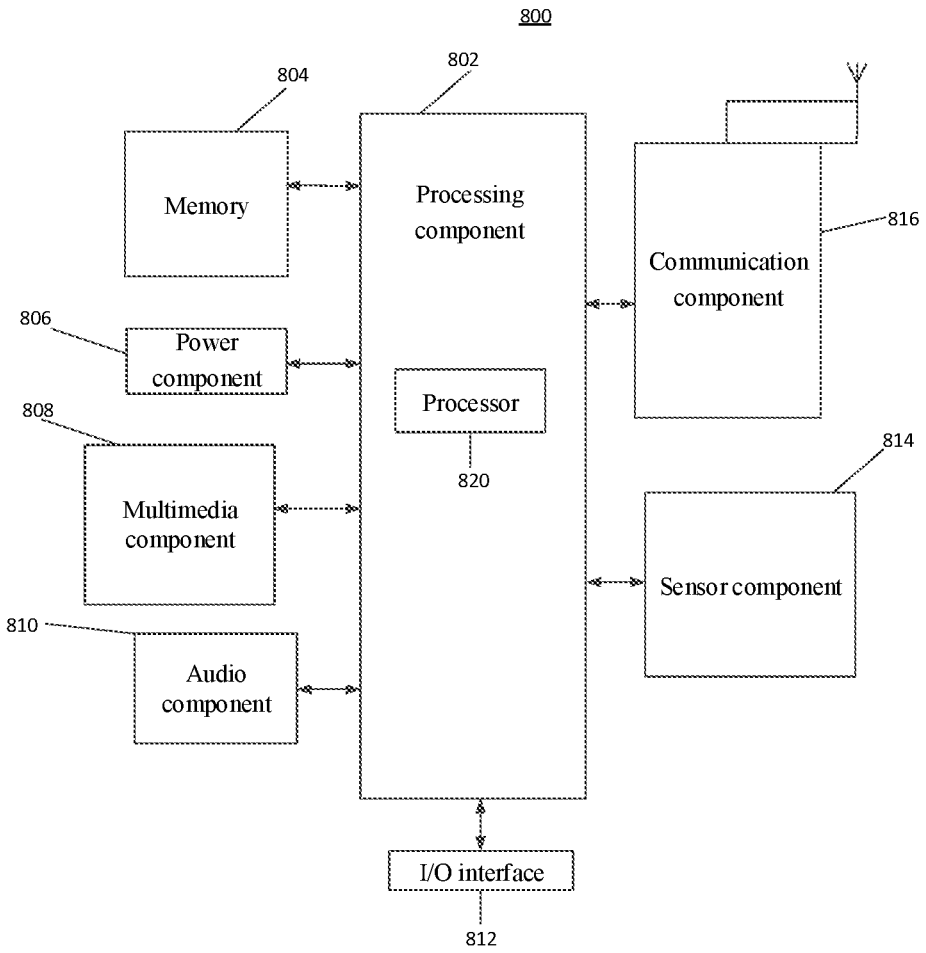
FIG. 10 is a block diagram of a whistling sound suppression apparatus according to one or more examples of the present disclosure.

FIG. 10 is a block diagram of the whistling sound suppression apparatus according to an example of the present disclosure. For example, the apparatus 800 may be a mobile phone, a mobile computer, or the like.

Referring to FIG. 10, the apparatus 800 may include one or more of the following components: a processing component 802, a memory 804, a power component 806, a multimedia component 808, an audio component 810, an input/output (I/O) interface 812, a sensor component 814, and a communication component 816.

The processing component 802 generally controls the overall operations of the apparatus 800, such as operations associated with display, telephone calls, data communications, camera operations, and recording operations. The processing component 802 may include one or more processors 820 to execute instructions to complete all or part of the steps of the method. In addition, the processing component 802 may include one or more modules to facilitate the interaction between the processing component 802 and other components. For example, the processing component 802 may include a multimedia module to facilitate the interaction between the multimedia component 808 and the processing component 802.

The memory 804 is configured to store various types of data to support the operations of the apparatus 800. Examples of such data include instructions for any application or method operating on the apparatus 800, contact data, phone book data, messages, pictures, videos, etc. The memory 804 may be implemented by any type of volatile or non-volatile storage device or their combination, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic disk or an optical disk.

The power component 806 provides power to various components of the apparatus 800. The power component 806 may include a power management system, one or more power supplies, and other components associated with generating, managing, and distributing power to the apparatus 800.

The multimedia component 808 includes a screen that provides an output interface between the apparatus 800 and a user. In some examples, the screen may include a liquid crystal display (LCD) and a touch panel (TP). If the screen includes the touch panel, the screen may be implemented as a touch screen to receive input signals from the user. The touch panel includes one or more touch sensors to sense touch, swiping, and gestures on the touch panel. The touch sensor may not only sense the boundary of the touch or swiping action, but also detect the duration and pressure related to the touch or swiping operation. In some examples, the multimedia component 808 includes a front camera and/or a rear camera. When the apparatus 800 is in an operation mode, such as a shooting mode or a video mode, the front camera and/or the rear camera may receive external multimedia data. Each of the front camera and the rear camera may be a fixed optical lens system or has a focal length and optical zoom capabilities.

The audio component 810 is configured to output and/or input audio signals. For example, the audio component 810 includes a microphone (MIC), and when the apparatus 800 is in an operation mode, such as a call mode, a recording mode, and a voice recognition mode, the microphone is configured to receive external audio signals. The received audio signals may be further stored in the memory 804 or transmitted via the communication component 816. In some examples, the audio component 810 further includes a loudspeaker configured to output audio signals.

The I/O interface 812 provides an interface between the processing component 802 and a peripheral interface module. The peripheral interface module may be a keyboard, a click wheel, buttons, and the like. These buttons may include, but are not limited to: a home button, a volume button, a start button, and a lock button.

The sensor component 814 includes one or more sensors configured to provide the apparatus 800 with various aspects of state assessment. For example, the sensor component 814 may detect the on/off status of the apparatus 800, and the relative positioning of components, such as a display and a keypad of the apparatus 800. The sensor component 814 may also detect the position change of the apparatus 800 or a component of the apparatus 800, the presence or absence of contact between the user and the apparatus 800, the orientation or acceleration/deceleration of the apparatus 800, and the temperature change of the apparatus 800. The sensor component 814 may include a proximity sensor configured to detect the presence of nearby objects when there is no physical contact. The sensor component 814 may also include a light sensor, such as a CMOS or CCD image sensor, for use in imaging applications. In some examples, the sensor component 814 may also include an acceleration sensor, a gyroscope sensor, a magnetic sensor, a pressure sensor, or a temperature sensor.

The communication component 816 is configured to facilitate wired or wireless communications between the apparatus 800 and other devices. The apparatus 800 may access a wireless network based on a communication standard, such as Wi-Fi, 2G, or 3G, or a combination of them. In one example, the communication component 816 receives a broadcast signal or broadcast related information from an external broadcast management system via a broadcast channel. In one example, the communication component 816 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology and other technologies.

In some examples, the apparatus 800 may be implemented by one or more application specific integrated circuits (ASICs), digital signal processors (DSPs), digital signal processing devices (DSPDs), programmable logic devices (PLDs), field programmable gate arrays (FPGAs), controllers, microcontrollers, microprocessors, or other electronic components to execute the above method.

In some examples, a non-transitory computer-readable storage medium including an instruction is further provided, such as the memory 804 including an instruction, and the above instruction may be executed by the processor 820 of the apparatus 800 to complete the above method. For example, the non-transitory computer-readable storage medium may be a ROM, a random access memory (RAM), a CD-ROM, a magnetic tape, a floppy disk, an optical data storage device, etc.

Other implementation solutions of the present disclosure will be apparent to those skilled in the art from consideration of the specification and practice of the disclosure disclosed herein. The disclosure is intended to cover any variations, uses, or adaptations of the disclosure following its general principles and including such departures from the disclosure as come within known or customary practice in the art to which the disclosure pertains. It is intended that the specification and examples be considered as exemplary only, with a true scope and spirit of the disclosure being indicated by the following claims.

It should be understood that the disclosure is not limited to the precise arrangements described above and shown in the accompanying drawings, and that various modifications and changes may be made without departing from the scope of the present disclosure. The scope of the disclosure is limited only by the following claims.

The invention claimed is:

1. A whistling sound suppression method, comprising:

obtaining an ambient audio signal, wherein the ambient audio signal is a sound signal in a surrounding environment of an earphone;

filtering the ambient audio signal according to a preset first filter group to obtain a first audio signal;

obtaining an ear canal audio signal, wherein the ear canal audio signal is a sound signal when the first audio signal propagates in an ear canal; and filtering a subsequently obtained ambient audio signal according to a preset second filter group to obtain a second audio signal in response to the ear canal audio signal meets a whistling condition, wherein a gain value of the preset second filter group is smaller than a gain value of the preset first filter group, wherein the ear canal audio signal meeting the whistling condition comprises:

a local peak-valley difference in a preset local frequency band range where a full-band peak point of the ear canal audio signal is located meets a first condition, and an amplitude change of the ear canal audio signal meets a second condition.

2. The whistling sound suppression method according to claim 1, wherein the first condition comprises:

the local peak-valley difference is greater than a first threshold.

3. The whistling sound suppression method according to claim 2, wherein the first condition comprises:

the local peak-valley difference is greater than a second threshold, wherein the second threshold is greater than the first threshold.

4. The whistling sound suppression method according to claim 3, further comprising:

filtering the subsequently obtained ambient audio signal according to a preset third filter group to obtain a third audio signal in response to the local peak-valley difference is greater than the second threshold.

5. The whistling sound suppression method according to claim 4, wherein the gain value of the second filter group is smaller than the gain value of the first filter group; and a gain value of the preset third filter group is smaller than the gain value of the second filter group.

6. The whistling sound suppression method according to claim 2, wherein a lower limit of the preset local frequency band range is the difference between the frequency of the full-band peak point and a preset frequency, an upper limit of the preset local frequency band range is the sum of the frequency of the full-band peak point and the preset frequency, and the preset frequency is 1000 Hz.

7. The whistling sound suppression method according to claim 1, wherein the second condition comprises:

an amplitude change trend of the ear canal audio signal is that an amplitude gradually increases.

8. The whistling sound suppression method according to claim 1, wherein the preset first filter group is configured for transparent filtering, and the preset second filter group is configured for transparent filtering and whistling sound suppression.

9. The whistling sound suppression method according to claim 1, wherein the preset first filter group comprises: a plurality of first filters;

the second filter group comprises: a plurality of second filters;

the plurality of first filters and the plurality of second filters are of the same number and are in one-to-one correspondence; and a gain value of each second filter is smaller than a gain value of the first filter corresponding to the second filter.

10. The whistling sound suppression method according to claim 9, wherein a frequency value of each second filter is equal to a frequency value of the first filter corresponding to the second filter; and a Q value of each second filter is equal to a Q value of the first filter corresponding to the second filter.

11. An earphone, comprising: a microphone, a loudspeaker, a processor, and a memory, wherein the memory stores a computer program capable of running on the processor, and when running the computer program, the processor is configured to execute a whistling sound suppression method, comprising:

obtaining an ambient audio signal, wherein the ambient audio signal is a sound signal in a surrounding environment of the earphone;

filtering the ambient audio signal according to a preset first filter group to obtain a first audio signal;

obtaining an ear canal audio signal, wherein the ear canal audio signal is a sound signal when the first audio signal propagates in an ear canal; and filtering a subsequently obtained ambient audio signal according to a preset second filter group to obtain a second audio signal in response to the ear canal audio signal meets a whistling condition, wherein a gain value of the preset second filter group is smaller than a gain value of the preset first filter group, wherein the ear canal audio signal meeting the whistling condition comprises:

a local peak-valley difference in a preset local frequency band range where a full-band peak point of the ear canal audio signal is located meets a first condition, and an amplitude change of the ear canal audio signal meets a second condition.

12. The earphone according to claim 11, wherein the microphone comprises a first microphone and a second microphone, the first microphone is disposed at a position, outside the ear canal, in the earphone when the earphone is worn, and the second microphone is disposed at a position, in the ear canal, in the earphone when the earphone is worn.

13. The earphone according to claim 11, wherein the first condition comprises:

the local peak-valley difference is greater than a first threshold.

14. The earphone according to claim 11, wherein a lower limit of the preset local frequency band range is the difference between the frequency of the full-band peak point and a preset frequency, an upper limit of the preset local frequency band range is the sum of the frequency of the full-band peak point and the preset frequency, and the preset frequency is 1000 Hz.

15. The earphone according to claim 11, wherein the second condition comprises:

an amplitude change trend of the ear canal audio signal is that an amplitude gradually increases.

16. The earphone according to claim 11, wherein the preset first filter group is configured for transparent filtering, and the preset second filter group is configured for transparent filtering and whistling sound suppression.

17. The earphone according to claim 11, wherein the preset first filter group comprises: a plurality of first filters;

the preset second filter group comprises: a plurality of second filters;

the first filters and the second filters are of the same number and are in one-to-one correspondence; and a gain value of each second filter is smaller than a gain value of the first filter corresponding to the second filter.

18. A non-transitory computer-readable storage medium, storing a computer program, wherein when the computer program is executed by a processor, a whistling sound suppression method is realized, comprising:

obtaining an ambient audio signal, wherein the ambient audio signal is a sound signal in a surrounding environment of an earphone;

filtering the ambient audio signal according to a preset first filter group to obtain a first audio signal;

obtaining an ear canal audio signal, wherein the ear canal audio signal is a sound signal when the first audio signal propagates in an ear canal; and filtering a subsequently obtained ambient audio signal according to a preset second filter group to obtain a second audio signal in response to the ear canal audio signal meets a whistling condition, wherein a gain value of the preset second filter group is smaller than a gain value of the preset first filter group, wherein the ear canal audio signal meeting the whistling condition comprises:

a local peak-valley difference in a preset local frequency band range where a full-band peak point of the ear canal audio signal is located meets a first condition, and an amplitude change of the ear canal audio signal meets a second condition.

* * * * *